US006401467B1

(12) United States Patent
Horey et al.

(10) Patent No.: US 6,401,467 B1
(45) Date of Patent: Jun. 11, 2002

(54) ICE THICKNESS CONTROL SYSTEM AND SENSOR PROBE FOR ICE-MAKING MACHINES

(75) Inventors: Leonard I. Horey, Shelton; Dennis W. Norwich, Sandy Hook; Sam O. Sman, West Haven, all of CT (US)

(73) Assignee: Technology Licensing Corporation, Tequesta, FL (US)

( * ) Notice: Subject to any disclaimer, the term of this patent is extended or adjusted under 35 U.S.C. 154(b) by 0 days.

(21) Appl. No.: 09/561,882

(22) Filed: May 1, 2000

(51) Int. Cl.[7] ..... F25C 1/12
(52) U.S. Cl. ..... 62/138
(58) Field of Search ..... 62/138, 139

(56) References Cited

U.S. PATENT DOCUMENTS

| | | | | | |
|---|---|---|---|---|---|
| 2,954,679 | A | * | 10/1960 | Blackett | 62/139 |
| 3,178,901 | A | * | 4/1965 | Blackett | 62/139 |
| 3,918,267 | A | * | 11/1975 | Canter | 62/138 |
| 4,199,956 | A | * | 4/1980 | Lunde | 62/138 |
| 4,601,176 | A | * | 7/1986 | Suyama | 62/138 |
| 4,823,556 | A | | 4/1989 | Chesnut | 62/139 |
| 5,022,233 | A | * | 6/1991 | Kirschner et al. | 62/138 |
| 5,761,919 | A | | 6/1998 | Wilson et al. | 62/138 |
| 5,761,920 | A | | 6/1998 | Wilson et al. | 62/138 |

* cited by examiner

*Primary Examiner*—William E. Tapolcai
(74) *Attorney, Agent, or Firm*—Pennie & Edmonds LLP

(57) ABSTRACT

The present invention provides an improved system and method for sensing of ice, particularly applicable in the control of ice thickness in automatic ice-making machines. The ice-making machine may be of the conventional type using a cold plate with water flowing over it. A thermistor bead temperature sensor is encapsulated in a metal housing, which is in turn mounted on a carrier. The position of the carrier is adjustable relative to the cold plate. The control system has several variable delays or time durations which optimize system performance: 1. Minimum harvest time delay, relative to the start of the ice-making cycle; 2. Threshold persistence time delay, requires that the signal sensor persists above the harvest threshold value for a certain amount of time (referenced to when the threshold is first exceeded), before harvesting may begin; 3. Harvesting delay is an optional delay provided give the option of making sure the ice is sufficiently "cured." These delay times may be implemented in hardware (by being built into the control logic), software, or by a combination of both hardware and software. The improved sensor and control concepts offer their own benefits and may be used separately or together.

12 Claims, 3 Drawing Sheets

ICE THICKNESS CONTROL SYSTEM AND SENSOR PROBE FOR ICE-MAKING MACHINES

TECHNICAL FIELD

The present invention relates to an improved ice thickness control system and associated sensor probe.

BACKGROUND OF THE INVENTION

Ice-making machines are known in the art. They can take various forms, but share the general basic attribute that water is brought into contact with a cold element, such as an ice plate or coil, which is cooled to below the freezing point of water. The cold element may be submerged in a pool of water, or the water may be provided in a flow over the cold element. In either design, ice will begin to form on the surface of the cold element, growing in size over time. Eventually, when enough ice is formed, it is "harvested," so that it may be used as cubes, etc.

For example, U.S. Pat. No. 5,761,919 discloses an automatic ice-making machine including a water reservoir 10 and a cold plate 14 with a surface shaped so as to form ice cubes. A pump 12 pumps the water from the reservoir over the cold plate. The cold plate is maintained at a temperature below freezing so that a thickness of ice 16 forms on the cold plate. A capacitance-sensing circuit 20 is used to determine when the built-up ice should be harvested.

It will be appreciated that all ice-making machines need a system, preferably an automated system, for determining when the ice has built up sufficiently to be harvested. It is important to be able to consistently harvest the ice at the right time, when the mass of ice being harvested has the appropriate thickness such that the resulting ice cubes will meet required dimensional tolerances. For example, if the ice is allowed to become too thick before harvesting, the ice cubes will tend to bind to each other, making them hard to separate. Alternatively, if the ice is harvested while it is still too thin, the ice cubes will be undersized, which is undesirable from the end user's perspective, as they will melt too quickly. Accordingly, there is a need in the art for an ice-making machine which can accurately determine when the ice should be harvested.

Typical prior art systems have used a variety of methods to detect the build-up of a sufficient amount of ice. Mechanical systems use micro-switches which are actuated when the ice surface contacts the switch. Such systems suffer from many drawbacks, including interference of ice with actuating parts, switch hysteresis, and tolerances.

Electrical resistance systems use metal a bridge sensor which conducts electricity when water is flowing over it. During the ice-making cycle, as the ice mass becomes thicker, it forces the flowing water to splash out further, eventually making continuous, or nearly continuous contact with the metal bridge, resulting in a substantially consistent signal in the associated circuit. This conductive signal is then interpreted by the system as an indication that the ice is thick enough to harvest. A serious drawback of this method is that water used in ice-making machines often contains impurities, which over time will coat a metal bridge sensor and stop it from conducting an electrical signal (the so-called "liming effect"). When this happens, the sensor must be serviced or replaced. In locations where there is a relatively high level of water impurities, this coating with impurities ("liming up") may occur very quickly. Accordingly, there is a need in the art for an ice-making machine ice sensor which is less susceptible to the liming problem than known sensors.

It is also known to use thermal detection systems which use temperature sensors placed appropriately such that when the ice builds out to and contacts the sensor, a unique thermal signature is presented to the detector. However, the prior art thermal detection systems have a poor signal-to-noise ratio, which makes them unable to provide reproducible harvesting cycles.

Accordingly, there is a need in the art for an ice-making machine sensor which has no moving parts, does not suffer from liming problems, and which can accurately and reproducibly determine when the ice should be harvested.

SUMMARY OF THE INVENTION

Accordingly, the invention addresses this need by providing an improved ice thickness sensing and control system using an improved temperature sensor and control logic having several adjustable delay times to optimize performance.

It will be appreciated by one of ordinary skill in the art that the control logic, including that implementing the delay times, may be implemented in hardware, firmware, software, or any combination of thereof, as a matter of design choice. Accordingly, the term "circuitry" as used herein means any combination of hardware, firmware, or software used to implement the control logic.

The invention is generally directed to an ice thickness control system which uses a temperature sensor mounted near the cold plate. As the ice thickens and gets closer to the sensor, the sensed temperature gets colder; finally when the ice is thick enough that it touches (or nearly touches) the sensor, the sensor will detect a very low temperature and will "notify" the control system to begin the harvesting process.

The invention is generally directed to a liquid-solidifying machine comprising a cold element, a liquid source, a temperature sensor, and circuitry associated with the sensor. The cold element includes a solid-forming surface which may be cooled to below the solidification point of the liquid. The liquid source provides liquid to the solid-forming surface such that a thickness of solid forms on the surface. The temperature sensor is provided with sufficient current that it self-heats to above the ambient temperature when the liquid-solidifying machine is in use. The circuitry associated with the sensor is operative to sense the temperature signal from the sensor, and detects when solid material formed on the cold surface is to be harvested.

In one embodiment, the liquid-solidifying machine is an ice-making machine; the liquid used in the system is water, and the solid is water ice. The temperature sensor in this embodiment self-heats sufficiently that no ice forms on the exterior surface of the sensor, preferably at least about 25° F. above ambient temperature when the machine is in use, more preferably at least about 75° F. above ambient temperature when the machine is in use. The temperature sensor is preferably a thermistor-type sensor, and may comprise a bead in a metal housing. The temperature signal from such sensors is not adversely affected by the deposition of impurities, from the liquid, on the exterior surface of the sensor. The temperature sensor may comprise a thermistor bead in a metal housing, the metal housing being mounted in a carrier, the position of the sensor relative to the solid-forming surface being adjustable.

The ice-making machine of the present invention comprises a cold element, a water source, a temperature sensor, and control logic associated with the sensor. The cold element includes an ice-forming surface which may be cooled to below the freezing point of water. The water source provides water to the ice-forming surface such that a thickness of ice forms on the surface during an ice-making cycle. The control logic detects when ice formed on the cold surface is to be harvested, and comprises a temperature signal threshold value, signal-sensing circuitry, threshold persistence circuitry, and harvesting cycle initiation circuitry. The temperature signal threshold value indicates when the thickness of ice is sufficiently close to the sensor such that it can be harvested. The signal-sensing circuitry is operative to sense the temperature signal from the sensor, the threshold persistence circuitry determines that the temperature signal has consistently remained above the threshold value for a threshold persistence time duration since the temperature signal first exceeded the threshold value. The harvesting cycle initiation circuitry initiates a harvesting cycle, during which the ice is removed from the ice-making surface.

The control logic may further comprise circuitry for determining that, starting from the beginning of the ice-making cycle, a minimum harvest time duration has elapsed, before the harvesting cycle can be initiated. It may also further comprise circuitry for determining that, starting from the end of the threshold persistence time duration, a harvesting delay time duration has elapsed, before a harvesting cycle can be initiated. The control logic may further comprise circuitry for determining that, starting from the end of the harvesting cycle, a recycling delay time duration has elapsed, before another ice-making cycle can be initiated.

A method of operating an ice-making machine is also provided, comprising the steps of: (a) providing a cold element; (b) providing a water source; (c) providing a temperature sensor; (d) providing circuitry associated with the sensor; (e) providing the circuitry with a temperature signal threshold value (which indicates when the thickness of ice is sufficiently close to the sensor such that it can be harvested); (f) initiating an ice-making cycle (during which the ice-making surface is cooled to below the freezing point of water, and water is provided to the ice-forming surface such that a thickness of ice forms on the surface); (g) a threshold persistence determination step, in which it is determined whether the temperature signal has consistently remained above the threshold value for a threshold persistence time duration since the temperature signal first exceeded the threshold value; and (h) a harvesting cycle initiation step, during which the ice is removed from the ice-making surface. The cold element includes an ice-forming surface which may be cooled to below the freezing point of water. The water source can provide water to the ice-forming surface. The circuitry associated with the sensor detects when ice formed on the cold surface is to be harvested, said circuitry being operative to sense the temperature signal from the sensor.

The steps (f) through (h) may be performed in alphabetical order, and may be repeated more than once. The method may include the further step of determining that, starting from the beginning of the ice-making cycle, a minimum harvest time duration has elapsed, before a harvesting cycle can be initiated. The method may also include the further step of determining that, starting from the end of the threshold persistence time duration, a harvesting delay time duration has elapsed, before a harvesting cycle can be initiated. The method may also include the further step of determining that, starting from the end of the harvesting cycle, a recycling delay time duration has elapsed, before another ice-making cycle can be initiated.

BRIEF DESCRIPTION OF THE DRAWINGS

The features and advantages of the present invention will become more readily apparent from the following detailed description of the invention in which like elements are labeled similarly and in which.

DETAILED DESCRIPTION OF THE PREFERRED EMBODIMENTS

Figure 1:
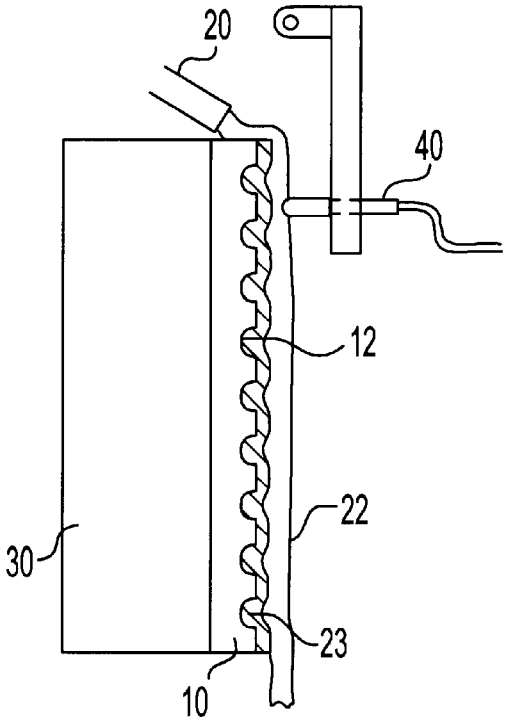
FIG. 1 is a schematic view of the ice-making machine of the present invention, including a temperature sensor and temperature-detection circuitry.

Referring to FIG. 1, an ice-making machine is schematically depicted as including a vertical cold plate 10, a water source 20, and a refrigeration system 30. It can be seen that the surface 12 of the cold plate on which the ice forms may be shaped with ridges and valleys so as to provide discrete cubes of ice when the ice is harvested. In this shaping aspect, the cold plate may be analogized to a vertically oriented ice cube tray as found in standard home refrigerators.

In operation, water 22 from source 20 flows over the ice-forming surface 12. Due to the refrigeration cooling the plate, the water turns to ice 23, progressively building up in thickness, as measured from surface 12, over time. When the system determines that the ice is fully formed, it is harvested.

The harvesting may be accomplished using a valve system, for example, such that instead of cold liquified gas being pumped past the cold plate to cool it, the exhaust or hot gas from the cooling compressor can be pumped past the cold plate, warming the plate and causing the ice to fall away. The completion of the harvesting step can be determined by known methods, either implicitly (determining that the harvesting has succeeded a given period of time after the cold plate was warmed up), or by a direct physical harvested-ice sensor, such as a mechanical flap switch which senses when the ice cubes drop away from the plate.

Figure 2:
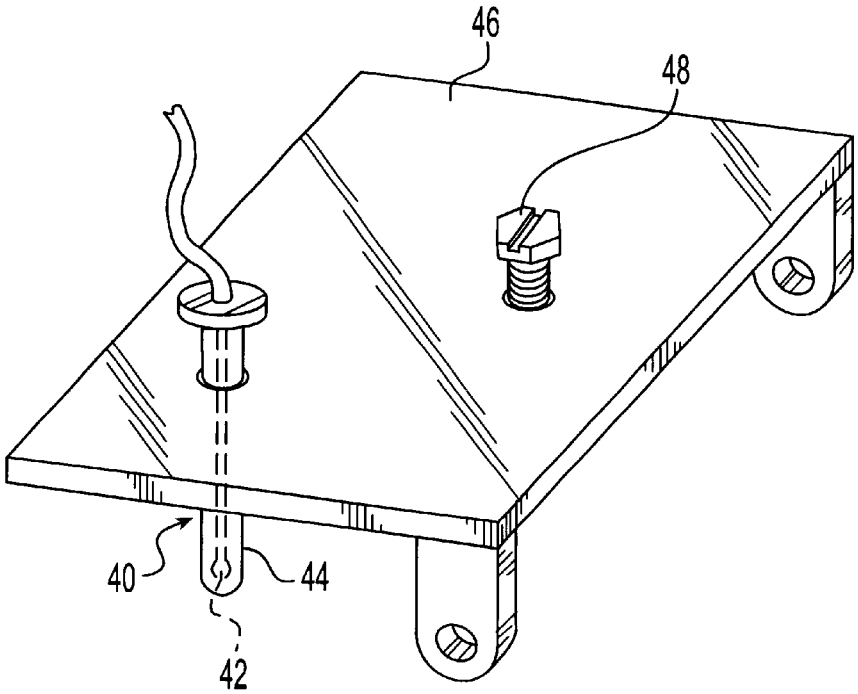
FIG. 2 is a schematic view of a temperature sensor.

The thermistor probe temperature sensor 40 is depicted in FIG. 2. In order to achieve accuracy and repeatability in the determination of the appropriate harvest time, a self-heated thermistor bead 42 is encapsulated in a metal housing 44, which is then in turn mounted in a carrier 46. The housing may be a thin-walled food-grade metallic well, such as a nickel-plated eyelet, in which the thermistor bead can be housed with the bead touching the extreme interior wall of the eyelet. The eyelet may then be inserted into the carrier and sealed. The carrier may be a molded plastic part, and may further be provided with a set screw 48 to allow adjustment of the separation between the sensor and the ice-forming surface, in order to allow for adjustment of the harvested ice thickness, and to ensure that the sensor is positioned at the same separation from the ice-forming surface 12 at the beginning of each ice-making cycle. The sensor is preferably of low mass, designed so that it has maximum physical protection while still having the minimal practicable thermal mass.

As seen in FIG. 2, the sensor is preferably positioned near an area of minimum ice thickness (i.e., near a "ridge" on the cold plate). This insures that at such time as the ice is sufficiently thick to be harvested, the sensor has not become embedded in, or surrounded by, the ice, as would occur if it was positioned near an area of maximum ice thickness (i.e., near a "valley" on the cold plate).

Figure 3:
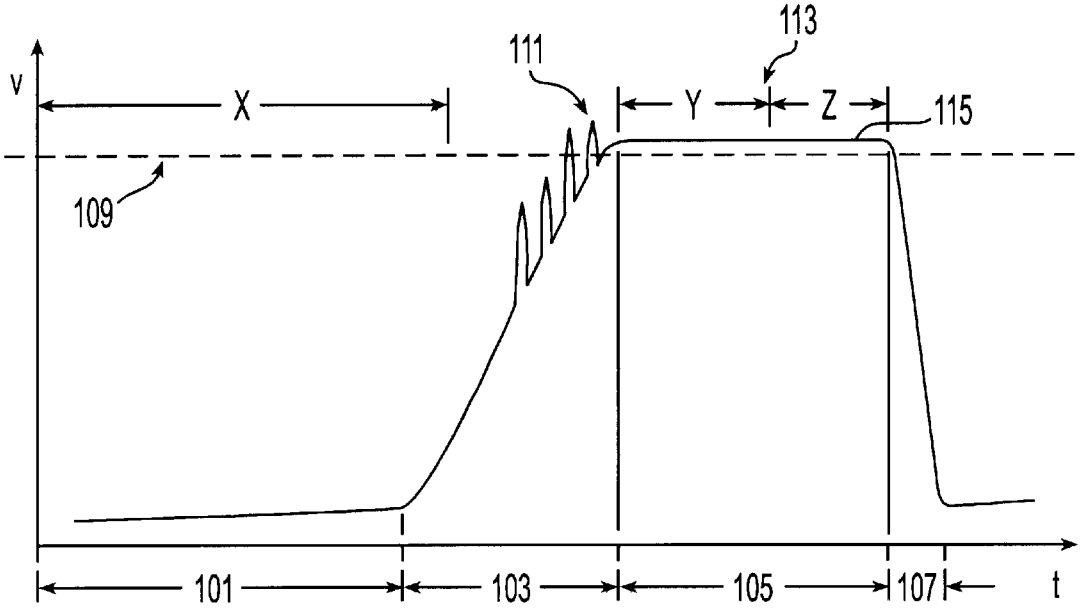
FIG. 3 illustrates the temperature signals present in the temperature-detection circuitry of FIG. 1.

Referring to FIG. 3, a graph of a signal in the temperature sensing circuit versus time is depicted. The graph shows the "temperature signal" which is physically the voltage signal from the thermistor probe. In typical circuits, such as shown here, the voltage signal is inversely proportional to the actual sensed temperature.

Figure 4A:
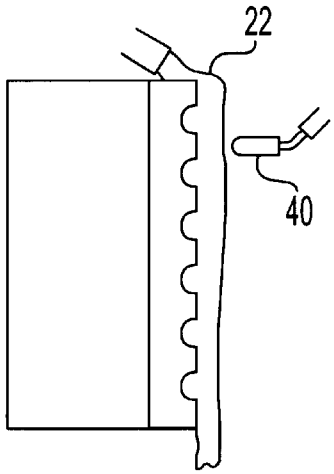
FIGS. 4A–4C are schematic views of the ice-making machine of the present invention, with various amounts of ice formation, corresponding to various temperature signals depicted in FIG. 3.

During the initial portion 101 of the ice-making cycle, the sensor 40 is sensing a steady-state temperature. This corresponds to the situation depicted in FIG. 4A, in which there is little or no ice formation, such that the ice mass 23 is a substantial distance from the sensor 40. In this regard, the self-heating feature of the sensor is significant, because the current in the thermistor is sufficient to heat it through the resistive heating effect, and thus the temperature of the sensor is internally biased. Depending on the level of current supplied and the physical characteristics of the thermistor, the self-heating effect may be substantial, biasing the temperature of the sensor above any possible ambient air temperature which would be expected during the normal operation of the ice-making machine, for example to 150° F.

When exposed only to the air, the temperature sensed by the sensor will stabilize at its self-heated temperature. As the approaching ice mass forces the water curtain over the sensor, the sensed temperature will drop down, and eventually, when a sufficient amount of the water curtain covers the sensor, the sensed temperature will drop below the threshold temperature. For consistency with usage in the art, the condition when the sensed temperature drops below the threshold value which indicates that the ice is ready to harvest may be referred to as the temperature threshold being "exceeded."

The thermistor-type sensor is advantageous because it does not operate based on conductivity, and thus the signal from the thermistor-type sensor is not adversely affected even when it becomes coated with water or deposits from the water.

Figure 4B:
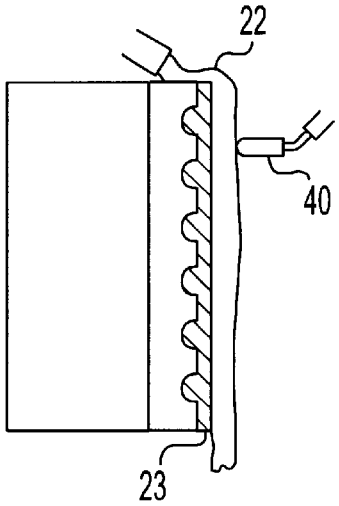
Figure 4C:
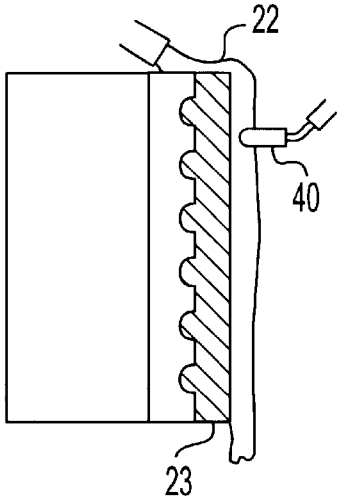

The voltage value will remain substantially constant at the low steady state value, while the ice thickness 23 begins to build up on the plate (but while it is still substantially far away from the sensor). As the water begins to get closer to the sensor however (portion 103 of the ice-making cycle, and as depicted in FIG. 4B), the sensed temperature will begin to decrease, with a resulting increase in the voltage. Ultimately as the water actually comes into contact with and envelops the sensor (portion 105 of the ice-making cycle, and as depicted in FIG. 4C), the sensed temperature will reach a minimum steady state value, and the voltage will correspondingly reach a high steady state value, which will persist until the harvesting process is performed, at which time the ice will fall away from the plate and the sensor, again exposing the sensor to the ambient temperature, thus increasing its temperature (portion 107 of the ice-making cycle). Following the harvesting, the system can be configured to automatically begin another ice-making cycle. The system may include a recycling delay time duration between the end of the harvesting cycle and the start of the subsequent ice-making cycle.

In general terms, the ice is ready for harvesting when the voltage exceeds a temperature signal threshold value 109 corresponding to the low steady state temperature of the sensor when the ice gets sufficiently close to the sensor. As a practical matter, the harvesting threshold voltage value should be set slightly below the maximum voltage which is produced by the sensor when it is fully enveloped in ice.

Based on practical considerations as determined by research and experimentation, there are three different delays, or time durations, which may be provided in the system:

The first delay or time duration is the Minimum harvest time delay (X). The temperature sensed by the thermistor is essentially ignored for a time X starting from the beginning of the ice-making cycle. This serves as a "reasonableness test," reflecting the fact that basic physical laws dictate that the ice cannot possibly be ready to harvest until a certain minimum amount of time has elapsed in the cycle, regardless of what the sensor indicates.

In the example of FIG. 3, it can be seen that temperature signal does not reach the threshold until after the delay X has expired. In a properly operating system, this would generally be the case.

The second delay or time duration is the Threshold persistence (Y). During the intermediate part 103 of the ice-making cycle, the temperature signal from the thermistor will not provide a consistently smooth or consistent value but rather exhibits fluctuations, seen as the "jaggies" in the graph of FIG. 3. The jaggies in the signal are particularly a problem as the ice surface gets close to the thermistor, since the running water flowing on the outer surface of the ice will tend to splash; the splashing droplets of water hitting the thermistor will cause the thermistor to momentarily sense a low temperature although it is not actually appropriate yet to perform the harvest. Thus this delay or duration Y may be implemented to require that the signal persists above the harvest threshold value for a certain amount of time (referenced to when the threshold is first exceeded), before harvesting may begin. If the threshold is only exceeded momentarily, and the signal dips back below the threshold before time Y has elapsed (as occurs at 111 in FIG. 3), harvesting will not begin. But when the signal exceeds the threshold and stays above the threshold for at least delay Y (as at 113), harvesting may begin, as long as other conditions (for example, the minimum harvest time delay) allow it.

The third delay or time duration is the Harvesting delay (Z); this is an optional delay or duration which may quite possibly be set to zero. It is adjusted based on the ambient temperature of the ice sensor, and is provided give the option of making sure the ice is sufficiently fully formed or "cured." This delay Z is referenced to the end of the delay Y, and is graphically reflected as the right-hand portion of the flat "plateau" region 115 of the graph of FIG. 3.

Figure 5:
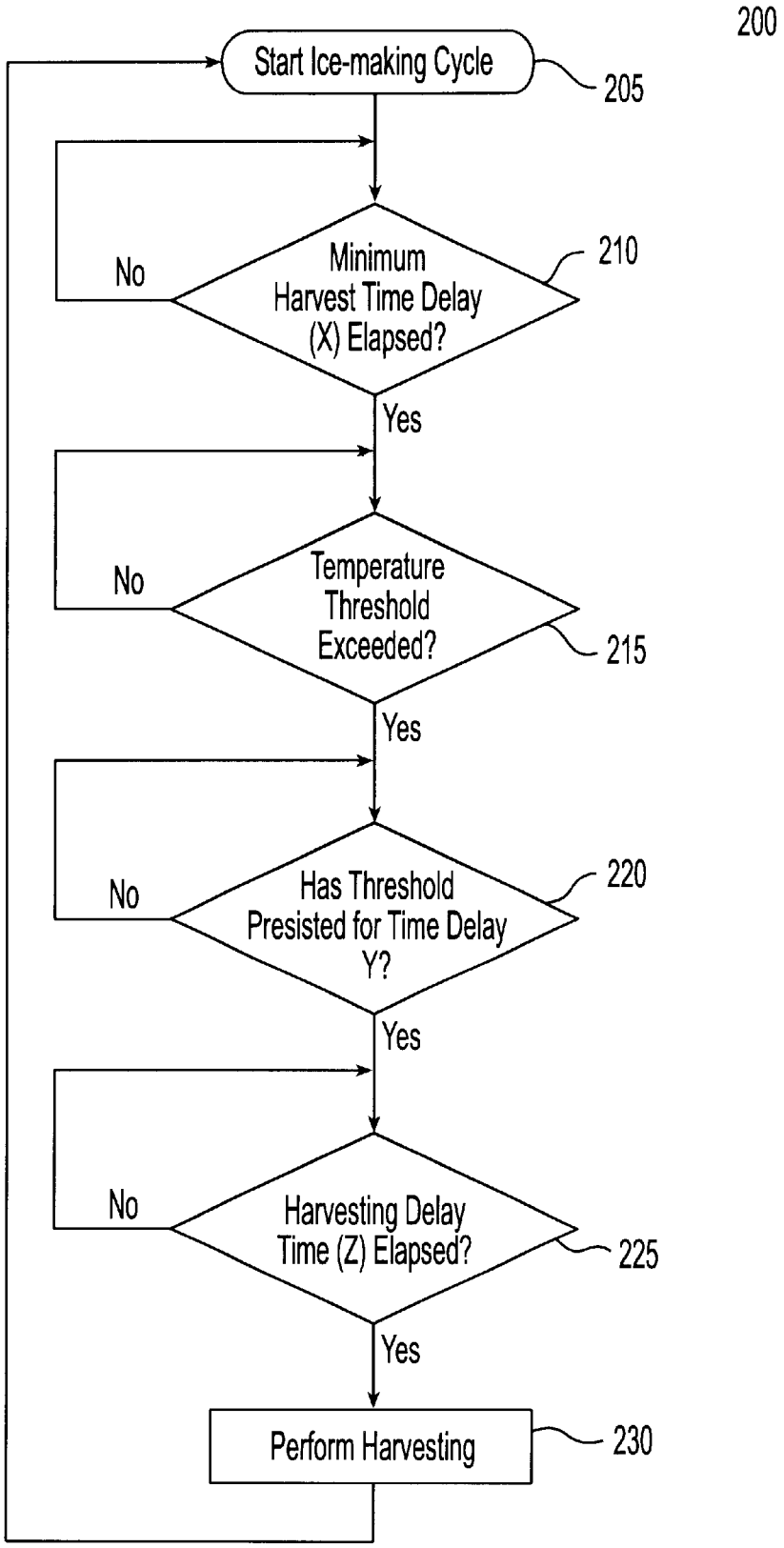
FIG. 5 is a flowchart describing an exemplary logic flow of the present invention.

FIG. 5 illustrates a logic flow chart for one implementation of the logic using the delay times discussed above. The logic process 200 begins the ice-making cycle in step 205. A test is performed in step 210 to determine whether the minimum harvest time delay (X) has elapsed, to serve as a "sanity check" in the logic, to ensure that harvesting cannot begin before the ice can reasonably be expected to be ready to harvest. Processing does not proceed to step 215 until step 210 determines that the minimum harvest time delay has elapsed. In step 215, a test is performed to determine whether the temperature threshold has been exceeded, indicating that the ice mass may have built up sufficiently to be ready to harvest. Processing does not proceed to step 220 until step 215 determines that the temperature threshold has been exceeded. In step 220, a test is performed to determine whether the temperature has persisted beyond the threshold for threshold persistence time delay (Y), to ensure that the temperature sensed in step 215 was not a transient spike, such as that caused by a splash of cold water. In the illustrated embodiment, if the persistence delay has not been satisfied, the logic simply stays in a loop at step 220 until it is satisfied. In an alternate embodiment however, the logic for the "NO" output of step 220 may return control to above step 215, such that processing does not return to step 220 until the test of 215 is satisfied. When it is determined that the persistence delay has been satisfied, processing proceeds to step 225, where a test is performed to determine whether the harvesting delay (Z) has elapsed. Processing does not proceed to the harvesting step 230 until that delay has elapsed. When processing has proceeded to step 230, and the harvesting has been performed, processing returns to step 205, where a new ice-making cycle is initiated.

The present invention is discussed herein with reference to a preferred embodiment using a ice plate, but one of ordinary skill in the art will readily understand that the invention is not limited to ice plate systems, but rather finds general application for use with any ice-making system such as those employing ice banks or ice packs. Indeed, the system is not limited to ice-making machines, but may generally be used in any application in which it is desired to detect the formation of ice. It will be further be appreciated that although the present invention is discussed in an embodiment of an ice-making machine, the invention is more generally applicable to any system in which any material (not only water) in its liquid state is cooled to its solid state. The modifications appropriate for such other applications may readily be realized by those of ordinary skill in the art and who have been equipped with the understanding of the structure and operation of the present invention as set forth in the above description. It will also be appreciated by one of ordinary skill in the art that the thermistor bead temperature sensor disclosed herein may be used whether or not the delay times are incorporated into the control system, and vice versa. Finally, it will be appreciated by one of ordinary skill in the art that the details of the design of the temperature sensor thermistor, the sensing circuitry, and the related software is a routine matter of design choice, and that the invention is not limited to the particular embodiments of those features depicted herein.

What is claimed is:

1. A liquid-solidifying machine comprising:

a cold element, including an solid-forming surface which may be cooled to below the solidification point of the liquid;

a liquid source which provides liquid to the solid-forming surface such that a thickness of solid forms on the surface;

a temperature sensor which is self-heated to above the ambient temperature when the liquid-solidifying machine is in use; and circuitry associated with the sensor for detecting when solid material formed on the cold surface is to be harvested, said circuitry being operative to sense the temperature signal from the sensor.

2. The liquid-solidifying machine of claim 1, wherein the liquid is water, and the solid is water ice, such that the liquid-solidifying machine is an ice-making machine.

3. The ice-making machine of claim 2, wherein the temperature sensor self-heats sufficiently that no ice forms on the exterior surface of the sensor.

4. The liquid-solidifying machine of claim 1, wherein the temperature sensor self-heats at least about 25° F. above ambient temperature when the machine is in use.

5. The liquid-solidifying machine of claim 1, wherein the temperature sensor self-heats at least about 75° F. above ambient temperature when the machine is in use.

6. The liquid-solidifying machine of claim 1, wherein the temperature sensor is a thermistor-type sensor.

7. The liquid-solidifying machine of claim 6, wherein the temperature sensor is provided with sufficient current to cause the self-heating.

8. The liquid-solidifying machine of claim 6, wherein the thermistor-type sensor comprises a bead in a metal housing.

9. The liquid-solidifying machine of claim 6, wherein the temperature signal from the sensor is not adversely affected by the deposition of impurities, from the liquid, on the exterior surface of the sensor.

10. The liquid-solidifying machine of claim 1, wherein the temperature sensor comprises a thermistor bead in a metal housing, the metal housing being mounted in a carrier, the position of the sensor relative to the solid-forming surface being adjustable.

11. The liquid-solidifying machine of claim 1, wherein the temperature sensor comprises a thermistor bead in a metal housing and the sensor self-heats at least about 25° F. above ambient temperature when the machine is in use.

12. The liquid-solidifying machine of claim 1, wherein the temperature sensor comprises a thermistor bead in a metal housing, the metal housing mounted in a carrier, the position of the sensor relative to the solid-forming surface being adjustable, and the sensor self-heats at least about 25° F. above ambient temperature when the machine is in use.

* * * * *